United States Patent [19]

Taniguchi

[11] 4,331,213

[45] May 25, 1982

[54] AUTOMOBILE EXHAUST CONTROL SYSTEM

[75] Inventor: Yoshifumi Taniguchi, Toyonaka, Japan

[73] Assignee: Mitsuko Leith, Honolulu, Hi.

[21] Appl. No.: 116,194

[22] Filed: Jan. 28, 1980

[51] Int. Cl.[3] ..... F01N 1/08; F01N 1/14

[52] U.S. Cl. ..... 181/263; 181/224; 181/272; 181/279

[58] Field of Search ..... 181/212, 220, 224, 262, 181/263, 264, 268, 269, 274, 272, 279, 280, 282, 283, 245

[56] References Cited

U.S. PATENT DOCUMENTS

| | | | |
|---|---|---|---|
| 965,135 | 7/1910 | Gibson | 181/280 |
| 2,646,854 | 7/1953 | Walker | 181/280 |
| 2,911,055 | 11/1959 | McDonald | 181/280 |
| 3,857,458 | 12/1974 | Ohtann et al. | 181/262 |
| 4,226,298 | 10/1980 | Bancel et al. | 181/277 |

FOREIGN PATENT DOCUMENTS

| | | | |
|---|---|---|---|
| 877384 | 5/1953 | Fed. Rep. of Germany | 181/240 |
| 701684 | 3/1931 | France | 181/280 |
| 521130 | 3/1955 | Italy | 181/279 |

*Primary Examiner*—L. T. Hix
*Assistant Examiner*—Benjamin R. Fuller
*Attorney, Agent, or Firm*—James C. Wray

[57] ABSTRACT

An exhaust gas control system has a guiding pipe with a proximal inlet end for connecting to a distal end of an engine exhaust pipe. An expanding portion of the guiding pipe has a central rearward expanding cone and spiralling blades extending between the cone and the walls of the expanding portion. The expanding portion is followed by an axially decreasing chamber and then an axially increasing chamber to the distal opening. A duct is supported on radial vanes around the latter chambers. The duct has a forward opening slightly rearward of a maximum cross-sectional dimension of the guiding pipe and has an outlet positioned rearward of the distal opening of the guiding pipe.

16 Claims, 2 Drawing Figures

AUTOMOBILE EXHAUST CONTROL SYSTEM

BACKGROUND OF THE INVENTION

Automobile exhaust gas control is subjected to severe regulatory measures today, and the tendency is towards the imposition of even more vigorous performance standards. The results are high fuel consumption, a considerable reduction in power output and greater noise from the engine which combine to make poorer performance.

SUMMARY OF THE INVENTION

This invention has as an object the provision of an automobile exhaust gas guiding pipe having an intake for connection to an engine exhaust pipe and spiralling series of guiding blades mounted inside the guiding pipe about a core. Exhaust gas coming from the engine exhaust pipe is guided in swirls through the guiding pipe. A venturi expands radially outward from the intake end, and the guiding blades extend along the guiding pipe walls.

Preferably the guiding blades terminate distally at a cross-sectional flow area of maximum dimension. A cone is positioned within an expanding portion of the guiding pipe. The cone has a closed small end near the intake and a large end near the area of maximum dimensions, and the guiding blades extend between the cone and a wall of the guiding pipe. A chamber connected to the area of maximum dimension has walls extending axially and inwardly to a throat area and an expansion chamber connected to the throat area has walls extending axially and radially outward to a distal opening.

In a preferred embodiment, a duct connected around a distal portion of the guiding pipe has an inlet end opening along an outer wall of the guiding pipe and has an outlet extended rearward from the distal opening of the guiding pipe, the duct thereby guiding ambient air over at least a distal portion of the guiding pipe.

These and other objects and features of the invention are apparent in the above and ongoing specification, with the claims and in the drawings.

DETAILED DESCRIPTION OF THE DRAWINGS

This invention improves aspects of car performance. The invented system is simple in structure, and its manufacturing cost is reasonably low. The system is fitted simply at the end of the exhaust pipe, and may contribute to a saving of fuel consumption, an increase in engine power, and decreases in noise and in emission temperature and pollutants.

Figure 1:
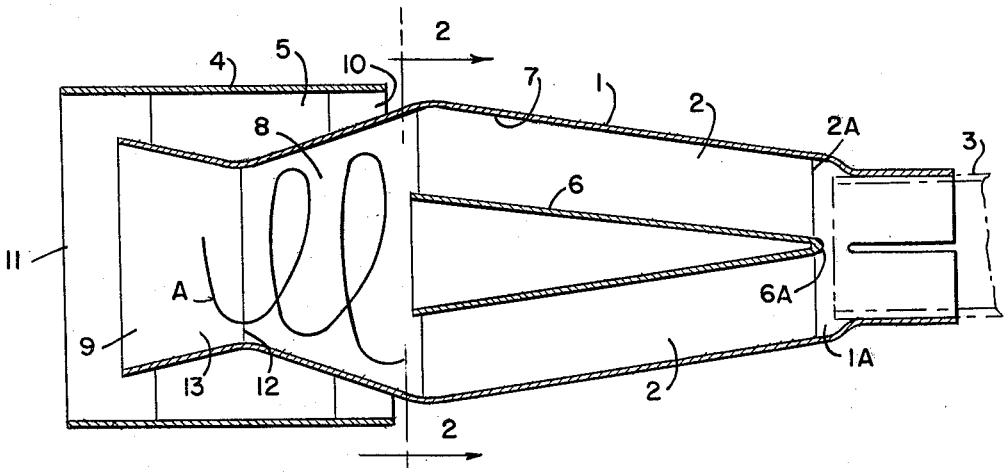
FIG. 1 is a side elevation, partially in section, showing the construction of an exhaust gas control system of the present invention.
Figure 2:
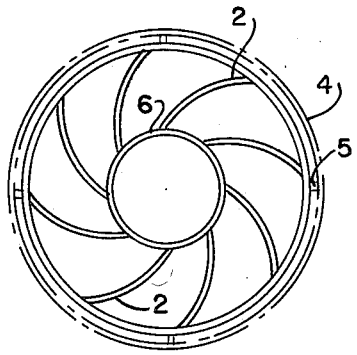
FIG. 2 is a view taken along line 2—2 of FIG. 1.

FIGS. 1 and 2 show an example of the way this invented system is installed. Guiding pipe 1 is the venturi type, which has a larger diameter at the center and a smaller diameter at the end. This guiding pipe 1 has a concentric core pipe 6 and a series of blades 2 in a spiral arrangement fitted laterally in the space between the inside wall of the guiding pipe and the core pipe. The blades are substantially longitudinally coextensive with the outwardly expanding portion of the guiding pipe 1, extending from forward ends 2A adjacent intake 1A to rear ends adjacent the area of maximum dimension of the outwardly extending portion of the guide pipe 1.

The intake end chamber 1A opens outward so that the forward end 6A of conical core pipe 6 and the forward ends 2A of blades 2 do not obstruct exhaust flow or reduce passage size.

Vacuum chamber 8 is formed at the outer end of the core pipe 6. Exhaust pipe 3 connects the engine exhaust and the guiding pipe 1. Duct 4 is installed at the outer end of the guiding pipe 1 by means of axially extending radial supporting plates 5. The duct 4 helps cool the guiding pipe 1 whose temperature rises considerably during operation.

Duct 4 channels ambient air in through intake 10 and over guiding pipe 1 by virtue of the venturi suction caused by exhaust gas flowing rearward from opening 9 in pipe 1. the flow through duct 4 is promoted while the vehicle is in motion by ram air through intake 10 and may be promoted by reduced air pressure at outlet 11 by virtue of gas flowing therefrom and air flowing thereabout. More complete oxidation may take place and the emission temperature is reduced thereby reducing pollutants.

In the gas exhaust control system of this invention, the exhaust gas from the exhaust pipe 3 passes through the circular space 7 where the gas flows in whirls A along the blades 2 installed in a spiral arrangement. As a result, when the gas, flowing in whirls, enters the vacuum chamber formed at the outer end of the core pipe 6, the center of the whirls A inside the vacuum chamber 8 has an extremely low pressure. This creates a stronger sucking effect and absorbs exhaust gas from the exhaust pipe 3 into the guiding pipe with maximum efficiency.

At the same time the gas is expanded in the passageway 7 and cooled along its outer surface, which further reduces pressure. The swirling gasses enter the converging chamber 8 and then as speed increases pass through the throat area 12. The gasses are uniformly expanded and slowed in chamber 13 until they reach opening 9.

Therefore, in the gas exhaust control system of this innovative design, because of the whirl revolutions A of the exhaust gas flowing through the vacuum chamber 8, the pressure in the center of the vacuum chamber 8 becomes extremely low, creating a sucking effect which draws exhaust gas in the exhaust pipe 3 into the guiding pipe 1 with maximum efficiency. The increased velocity and improved smoothness in the exhaust gas flow through the exhaust pipe 3 result in a full drawing of the exhaust gas and carbon from the engine cylinders. In this way, improve combustion may be achieved, along with saving fuel consumption, boosting engine power, and reducing noise.

This invention is applicable to all types of cars since no difficulty is involed in installation at the end of the exhaust pipe 3. It should also be noted that the efficiency of this new system improves in parallel with the higher rotations of the engine and with the higher speed of the car. A faster flow of exhaust gas prompts the spiral motion of the whirls A and the air becomes thinner as it enters the vacuum chamber 8. As a result, the sucking power is improved. With this innovation, therefore, merit may be found in the saving of fuel consumption when the car runs at high speeds and otherwise consumes more.

Needless to say, this system is applicable not only on gasoline engine vehicles but on diesel engine cars as well.

I claim:

1. An exhaust gas control system comprising an exhaust gas guiding pipe having a proximal intake end for connection to an exhaust pipe, and having a portion which expands outwardly from the intake end, a spiral-lying series of guiding blades mounted in the outwardly expanding portion of the guiding pipe about an outwardly expanding core so exhaust gas entering the intake end from the exhaust pipe is guided in swirls of increasing radius through the guiding pipe, the guiding pipe having a distal opening for releasing the swirling exhaust gas.

2. The exhaust gas control system of claim 1 wherein the guiding blades terminate distally at a cross-sectional flow area of maximum dimension.

3. The exhaust gas control system of claim 1 further comprising a chamber connected to the distal end of the outwardly expanding portion, the chamber having walls extending axially and inwardly to a throat area and further comprising an expansion chamber connected to the throat area and having walls extending axially and radially outward to the distal opening.

4. The exhaust gas control system of claim 1 wherein the core comprises a cone having a closed small end near the intake end and having a large end near the area of maximum dimension of the outwardly expanding portion of the guiding pipe.

5. The exhaust gas control system of claim 1 wherein the guiding blades extend outwardly from the core to a wall of the guiding pipe.

6. The exhaust gas control system of claim 1 wherein the guiding blades are substantially longitudinally coextensive with the outwardly expanding portion of the guiding pipe.

7. The exhaust gas control system of claim 1 wherein the guiding blades comprise a plurality of longitudinally extending spiralling blades.

8. The exhaust gas control system of claim 1 wherein the outwardly expanding portion of the core is substantially parallel to the outwardly expanding portion of the guiding pipe.

9. The exhaust gas control system of claim 1 wherein the core has a substantially conical shape.

10. The exhaust gas control system of claim 1 wherein the intake end comprises an opening formed in a plane substantially perpendicular to a longitudinal axis of the guiding pipe.

11. An exhaust gas control system comprising an exhaust gas guiding pipe having an intake end for connection to an exhaust pipe, a spiralling series of guiding blades mounted in the guiding pipe, a core positioned in the guiding pipe so exhaust gas from the exhaust pipe is guided in swirls through the guiding pipe, the guiding pipe having an outwardly expanding distal end provided with an opening in a plane substantially perpendicular to the longitudinal axis of the guiding pipe for releasing the swirling exhaust gas, and a cylindrical duct concentrically spaced about the distal end of the guiding pipe, the duct having an inlet end opening formed between the proximal end of the duct and the outer wall of the guiding pipe and having a distal outlet end extending rearward from the distal end of the guiding pipe to form a distally contracting passageway between the duct and the guiding pipe, the duct thereby guiding ambient air over at least a distal portion of the guiding pipe and expelling said air at reduced pressure from the distal open end of said contracting passageway.

12. The exhaust gas control system of claim 11 further comprising axially extending radial supporting plates connecting the duct to an outer wall of the guiding pipe.

13. The exhaust gas control system of claim 12 wherein the supporting plates are circumferentially spaced about the guiding pipe.

14. The exhaust gas control system of claim 11 wherein the core comprises an outwardly expanding cone positioned within an outwardly expanding section of a proximal portion of the guiding pipe, the cone having a closed small end near the intake end and having a large end near the area of maximum dimension of the guiding pipe, and the guiding blades positioned between the cone and a wall of the guiding pipe.

15. The exhaust gas control system of claim 11 wherein the distal portion of the guiding pipe comprises an inwardly tapering proximal section and an outwardly tapering distal section terminating in said distal opening, the duct inlet opening being positioned slightly rearward of the area of maximum dimension of the tapering proximal section.

16. The exhaust control apparatus of claim 15 wherein the duct opening is positioned slightly rearward of the area of maximum dimensions of the guiding pipe.

* * * * *